US011857057B2

(12) United States Patent
Chen

(10) Patent No.: US 11,857,057 B2
(45) Date of Patent: Jan. 2, 2024

(54) REPLACEMENT-TYPE CONTAINER

(71) Applicant: Yuyao Caiyun Cosmetics Packaging Co. LTD., Yuyao (CN)

(72) Inventor: Jiabin Chen, Yuyao (CN)

(73) Assignee: Yuyao Caiyun Cosmetics Packaging Co. LTD., Yuyao (CN)

( * ) Notice: Subject to any disclaimer, the term of this patent is extended or adjusted under 35 U.S.C. 154(b) by 224 days.

(21) Appl. No.: 17/383,178

(22) Filed: Jul. 22, 2021

(65) Prior Publication Data

US 2022/0395077 A1 Dec. 15, 2022

(30) Foreign Application Priority Data

Jun. 10, 2021 (CN) ..... 202121302351.X

(51) Int. Cl.

| | |
|---|---|
| ***B65D 85/72*** | (2006.01) |
| ***A45D 40/16*** | (2006.01) |
| ***A45D 40/04*** | (2006.01) |
| *A45D 40/00* | (2006.01) |

(52) U.S. Cl.

CPC ..... *A45D 40/16* (2013.01); *A45D 40/04* (2013.01); *A45D 2040/0043* (2013.01); *A45D 2200/05* (2013.01)

(58) Field of Classification Search

CPC ..... B65D 83/0011; A45D 2200/05; A45D 2040/0043

USPC ..... 206/385

See application file for complete search history.

(56) References Cited

U.S. PATENT DOCUMENTS

| | | | | |
|---|---|---|---|---|
| 2004/0206783 | A1* | 10/2004 | Danne | B65D 83/0011 222/390 |
| 2009/0324321 | A1* | 12/2009 | Nasu | B65D 83/0011 401/172 |
| 2016/0029771 | A1* | 2/2016 | Walling | B65D 25/34 220/23.91 |
| 2019/0110575 | A1* | 4/2019 | Thulin | B65D 83/0011 |
| 2019/0133298 | A1* | 5/2019 | Bushell | A45D 40/04 |
| 2021/0061533 | A1* | 3/2021 | Chen | B65D 83/0011 |
| 2022/0061498 | A1* | 3/2022 | Abergas | A61K 8/922 |

* cited by examiner

*Primary Examiner* — Luan K Bui

(74) *Attorney, Agent, or Firm* — Schwegman Lundberg & Woessner, P.A.

(57) ABSTRACT

A replacement type container includes a replacement type component, an accommodating cavity is provided in the replacement component, and a first clasp is provided at a bottom of the replacement component. A second clasp is provided on the base, so that the first clasp and the second clasp can be snapped or separated by a relative rotation of the replacement component and the base. The bottom cover has a first through hole and the bottom cover is snapped with the replacement component The rotating component includes a base and a screw. The screw is fixed on the base, and the base has a third clasp for snapping with an edge of the first through hole; and the screw passes through the first through hole and is connected with the base so that a rotation of the screw causes the base to move so as to lift the replacement component.

19 Claims, 16 Drawing Sheets

REPLACEMENT-TYPE CONTAINER

CROSS REFERENCE TO RELATED APPLICATION

This application claims priority to and incorporates by reference Chinese Patent Application No. 202121302351.X filed 2021-06-10.

TECHNICAL FIELD

The disclosure relates to the technical field of packaging, in particular to a replacement type container.

BACKGROUND ART

Pasty daily chemical products such as lipsticks, lip balms, lip glosses, skin creams and body balms are moister, easy to make up and easy to be portable. However, unlike fluid daily chemical products, the pasty daily chemical products are relatively fixed in shape and difficult to replace.

Most of existing containers for storing pasty products such as body balms are disposable. This kind of container includes a bottle body, a hollow rotating base is provided at a bottom of the bottle body and a pushing screw is provided on the rotating base. The pushing screw is arranged in a center of the rotating base, and the screw is snap-fastened with the base by an arc bar. However, this rotary bottle cannot be reused after use, which causes environmental pollution.

There are also some replacement type containers, in which a house and a replacement type core are respectively provided with a pressing elastic snap and a snapping groove mutually matched with each other. When a replacement is required, the elastic snap can be pushed by a finger, so that the elastic snap can be drawn out of the snapping groove, and at this time the replacement type core can be pulled out of the house. However, the elastic snap of such a container is particularly easy to derail from the snapping groove or to lose elasticity due to material aging, which is inconvenient to use. Secondly, an installation and assembly process of the container with this structure is complicated. Furthermore, the replacement type core in some of the replacement type containers is directly placed on a liftable bottom plate. However, as paste inside the container is gradually reduced in use, weight of the replacement type core is getting smaller and smaller, and a dislocation is prone to occurring in a lifting process.

SUMMARY

In order to address at least a shortcoming in the prior art, the disclosure provides a replacement type container which has simple structure and does not need to be provided with a pressing elastic snap.

In order to achieve above purposes, the disclosure provides a replacement type container, which includes a replacement type component, a base, a bottom cover and a rotating component. An accommodating cavity is provided in the replacement component, and a first clasp is provided at a bottom of the replacement component. A second clasp corresponding to the first clasp is provided on the base, so that the first clasp and the second clasp can be snapped or separated by a relative rotation of the replacement component and the base. The bottom cover is provided with a first through hole and is snapped with a lower end of the replacement component. The rotating component includes a base and a screw. The screw is fixed on the base, and the base is provided with a third clasp for snapping with a hole edge of the first through hole; and the screw passes through the first through hole and is connected with the base so that a rotation of the screw causes the base to move so as to lift the replacement component.

A method of using the replacement type container provided in the disclosure is as follows: the accommodation cavity of the replacement type component can be configured to store pasty daily chemical products such as body balms, but also can be configured to store other articles such as flavorings, drinks, etc.; when the screw is rotated, the base connected with the screw is driven to move, so that the replacement type component snapped with the base is driven to lift, and thus the user can access contents in the replacement type component. When the replacement component is required to be replaced, it can be removed only by rotating the replacement component so that the replacement component and the base rotate relatively to each other and the first clasp and the second clasp are separated with each other. When the replacement component is installed, the first clasp and the second clasp can also be snapped with each other by rotating, thus finally realizing disassembly and installation of the base and the replacement component.

In the disclosure, with an ingenious design of the first clasp, the second clasp, the third clasp and the first through hole, three functions of taking the contents, disassembling the replacement component and installing the replacement component can be realized only by rotating, without any pressing elastic snap. Furthermore, the third clasp and the first through hole are respectively provided on the base and the bottom cover, so that when the replacement component and the base rotate relatively to each other, the base and the bottom cover also rotate relatively to each other, and at this time the third clasp is always snapped with the hole edge, thus maintaining a connection relationship between the base and the bottom cover. Moreover, the replacement components can be separately assembled and sold, and the screw does not contact with the contents in the accommodation cavity, so that there will be no residual content on threads of the screw.

Optionally, the replacement type container further includes a threaded pushing tube which is threadedly matched with the screw, a top of the threaded pushing tube is detachably connected with the bottom of the replacement component, and the threaded pushing tube and the base are respectively provided with a guide and a rail mutually matched with each other so that the screw is connected with the base, and a rotation of the screw causes the base to move, and the rotation of the screw drives the threaded pushing tube which is threadedly matched with the screw to move, while the threaded pushing tube can only move in a preset rail direction under an action of the guide and the rail; optionally, the guide and the rail are both arranged along an axial direction of the screw, so that the threaded pushing tube moves along the axial direction, thereby driving the base to move along the axial direction, that is, to lift, Optionally, the bottom of the replacement component is also provided with a fourth clasp and the top of the threaded pushing tube is provided with a fifth clasp corresponding to the fourth clasp, so that the fourth clasp and the fifth clasp can be snapped or separated with each other by a relative rotation of the replacement component and the threaded pushing tube, and a provision of the fourth clasp and the fifth clasp further stabilizes the installation of the replacement component.

Optionally, the base is provided with a second through hole, the screw passes through the first through hole and is connected with a bottom of the threaded pushing tube, and the threaded pushing tube passes through the second through hole and is connected with the bottom of the replacement component.

Optionally, rotation angles for the replacement component being snapped with the threaded pushing tube and the base respectively are the same, and rotation angles for the replacement component being separated with the threaded pushing tube and the base respectively are the same. With this design, when rotated to a certain angle, the replacement component is respectively snapped or separated with the threaded pushing tube and the base, thus improving efficiency.

Optionally, the replacement component includes an accommodating box and a bottom plate. A top of the accommodating box is defined with an opening, the bottom plate is arranged at a bottom of the accommodating box, the fourth clasp is arranged on the bottom plate, the first clasp is arranged at the bottom of the accommodating box, and the bottom of the accommodating box is defined with a third through hole. The fourth clasp passes through the third through hole and is snapped with the fifth clasp.

Optionally, the replacement component further includes a lower cover and an upper cover. The lower cover is snapped with a lower end of the accommodating box, and the upper cover is in interference fit with an upper end of the accommodating box. When the replacement component is installed, the lower cover needs to be removed for installation, and the upper cover can also be detachably connected with the upper end of the accommodating box.

Optionally, there are a plurality of first clasps, a plurality of second clasps and a plurality of fifth clasps, and the plurality of first clasps, the plurality of second clasps and the plurality of fifth clasps are respectively axially symmetrically distributed.

Optionally, the base is provided with axially symmetrically distributed first notches, and the first notches are arranged between every adjacent second clasps. The top of the threaded pushing tube is provided with axially symmetrically distributed second notches, and the second notches are arranged between every adjacent fifth clasps. Positions of the first notches corresponds to positions of the second notches, and positions of the plurality of second clasps are in one-to-one correspondence with positions of the plurality of fifth clasps, so as to ensure that the disassembly and installation of the threaded pushing tube and the replacement component keeps synchronized with the disassembly and installation of the replacement component and the base.

Optionally there are a plurality of third clasps which are symmetrically distributed, the first through hole is a circular through hole. One or more of the plurality of third clasps include extension portions extending radially along the circular through hole and snapping portions. After the extension portions extend into the circular through hole, the snapping portions snap a hole edge of the circular through hole.

Optionally, the base is further provided with a slide rail, and the first clasp also includes an extension portion extending along the radial direction of the screw and a snapping portion. After the extension portion of the first clasp extends into the first notch and rotates along the slide rail, the snapping portion snaps the second clasp. Numbers of the first notch, the first clasp and the second clasp is related to a final rotation angle.

The threaded pushing tube is also provided with a rail, a bottom of the bottom plate is provided with a bulge, and a lower end of the bulge is provided with a thurth clasp. After an extension portion of the fourth clasp extends into the second notch and then rotates along the rail, the fourth clasp is engaged with the fifth clasp.

Optionally, the rotating component further includes a rotating bottom cover. The rotating bottom cover and the base are respectively provided with a clasp and a snapping groove mutually matched with each other, and rotation preventing ribs mutually matched with each other are respectively provided on the rotating bottom cover and the base so as to ensure that these two parts rotate synchronously.

Optionally, a middle of the bottom cover is recessed inwards, and the first through hole is arranged at this recess, the rotary bottom cover is snapped with the base passing through the first through hole, and the rotary bottom cover is hidden in the recess in the middle of the bottom cover. A bottommost end of the rotary bottom cover can be ci flush with or slightly higher than a bottommost end of the bottom cover, which is convenient for the container to stand and place, and the recess can be a LI-shaped recess, thus reserving a space for the rotary bottom cover to rotate.

Optionally, a shape of the rotary bottom cover is spherical segment shaped, and an expression "spherical segment shaped" means a part cut off from a ball by a plane in another possible embodiment, the rotary bottom cover can also be cylindrical or of other shapes, and an outer wall of the rotary bottom cover can also be provided with stripes for increasing friction.

Optionally, the replacement type container further includes a top cover, and the replacement component is arranged in a cavity formed by snapping the top cover and the bottom cover, and the base is arranged in a cavity formed by snapping the base and the bottom cover. An entire shape of the replacement type container can be cylindrical, elliptic cylindrical, prismatic, etc., preferably flat, such as an elliptical cylinder, a flat quadrangular prism and the like, which is convenient for rotation. Moreover, the entire shape is jointly determined by shapes of the top cover and the bottom cover. After the whole container is covered with the top cover, exposed parts are only the top cover, the bottom cover and the rotating bottom cover, which is simple and elegant in appearance and convenient for storage.

To sum up, in the replacement type container according to this disclosure, with an ingenious design of the first clasp, the second clasp, the third clasp and the first through hole, three functions of taking the contents, disassembling the replacement component and installing the replacement component can be realized only by rotating, without any pressing elastic snap. Furthermore, the third clasp and the first through hole are respectively provided on the base and the bottom cover, so that when the replacement component and the base rotate relatively to each other, the base and the bottom cover also rotate relatively to each other, and at this time the third clasp is always snapped with the hole edge, thus maintaining a connection relationship between the base and the bottom cover.

DETAILED DESCRIPTION

Figure 1:
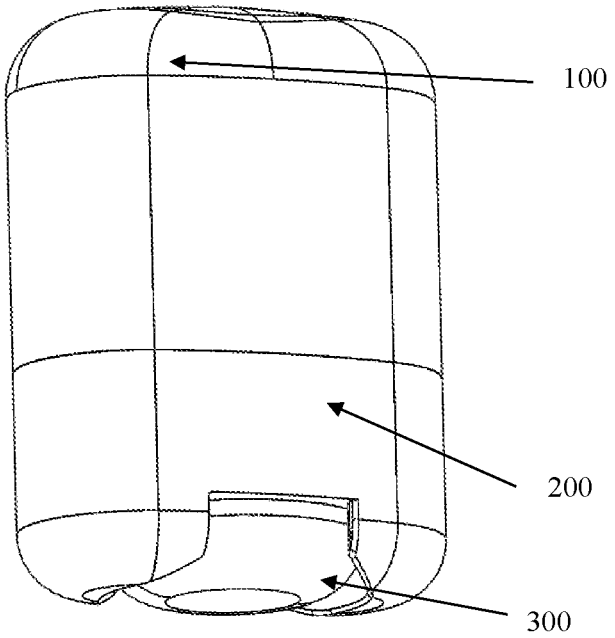
FIG. 1 is a schematic diagram of a replacement type container according to Embodiment 1 of the disclosure.
Figure 2:
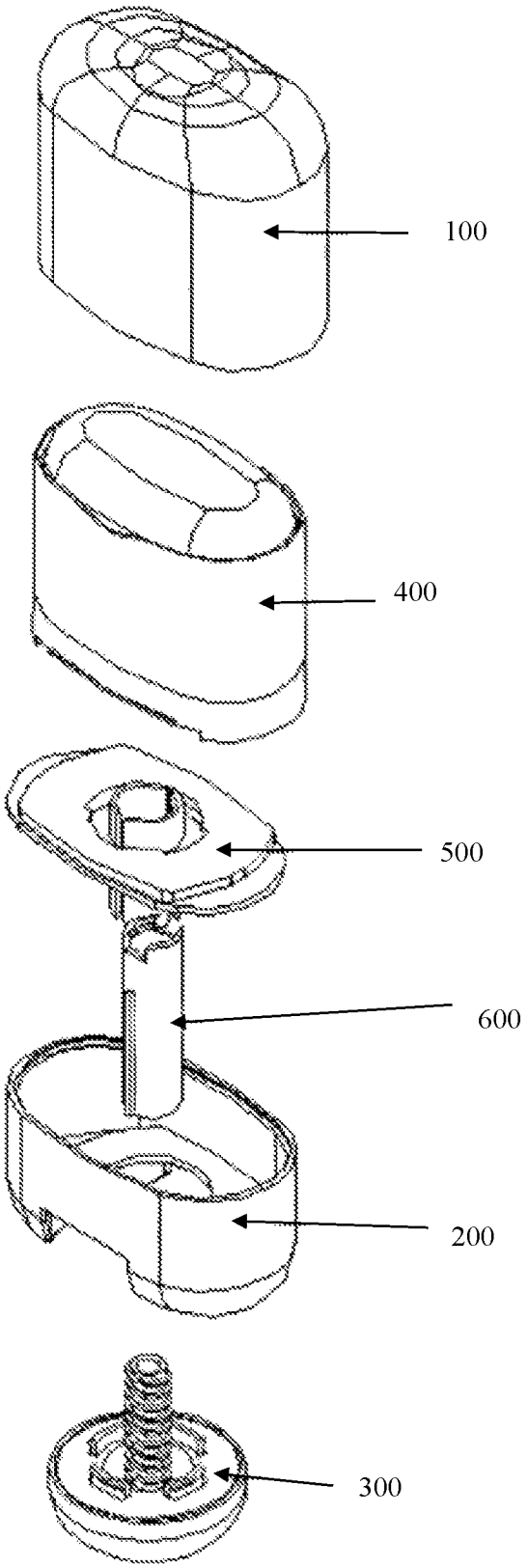
FIG. 2 is an exploded view of the replacement type container according to Embodiment 1 of the disclosure.
Figure 3:
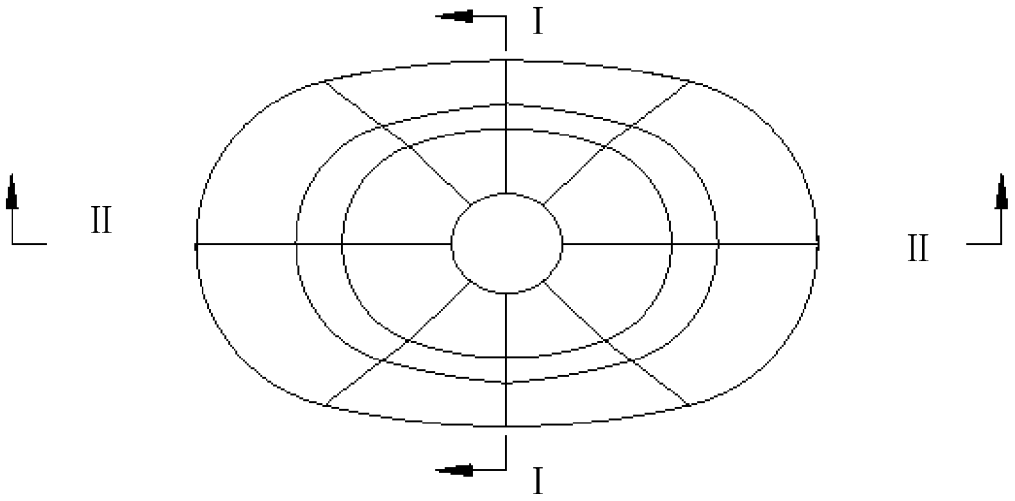
FIG. 3 is a top view of the replacement e container according to Embodiment 1 of the disclosure.
Figure 4:
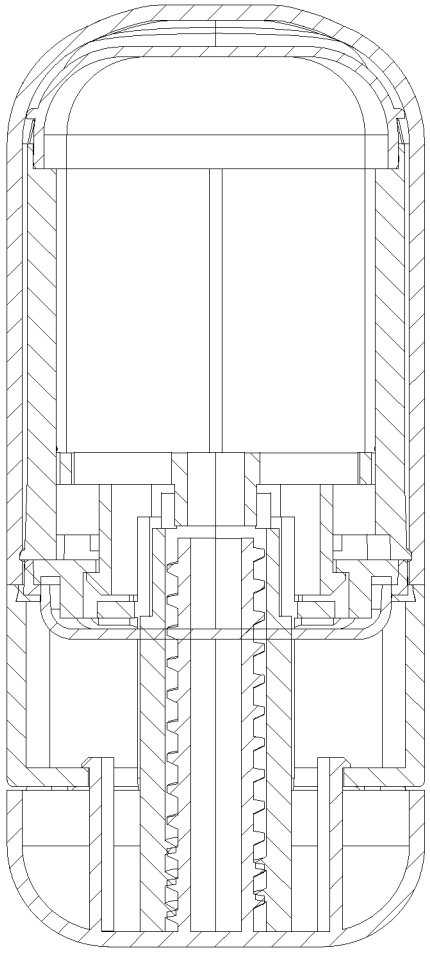
FIG. 4 is a sectional view taken along A-A in FIG. 3.
Figure 5:
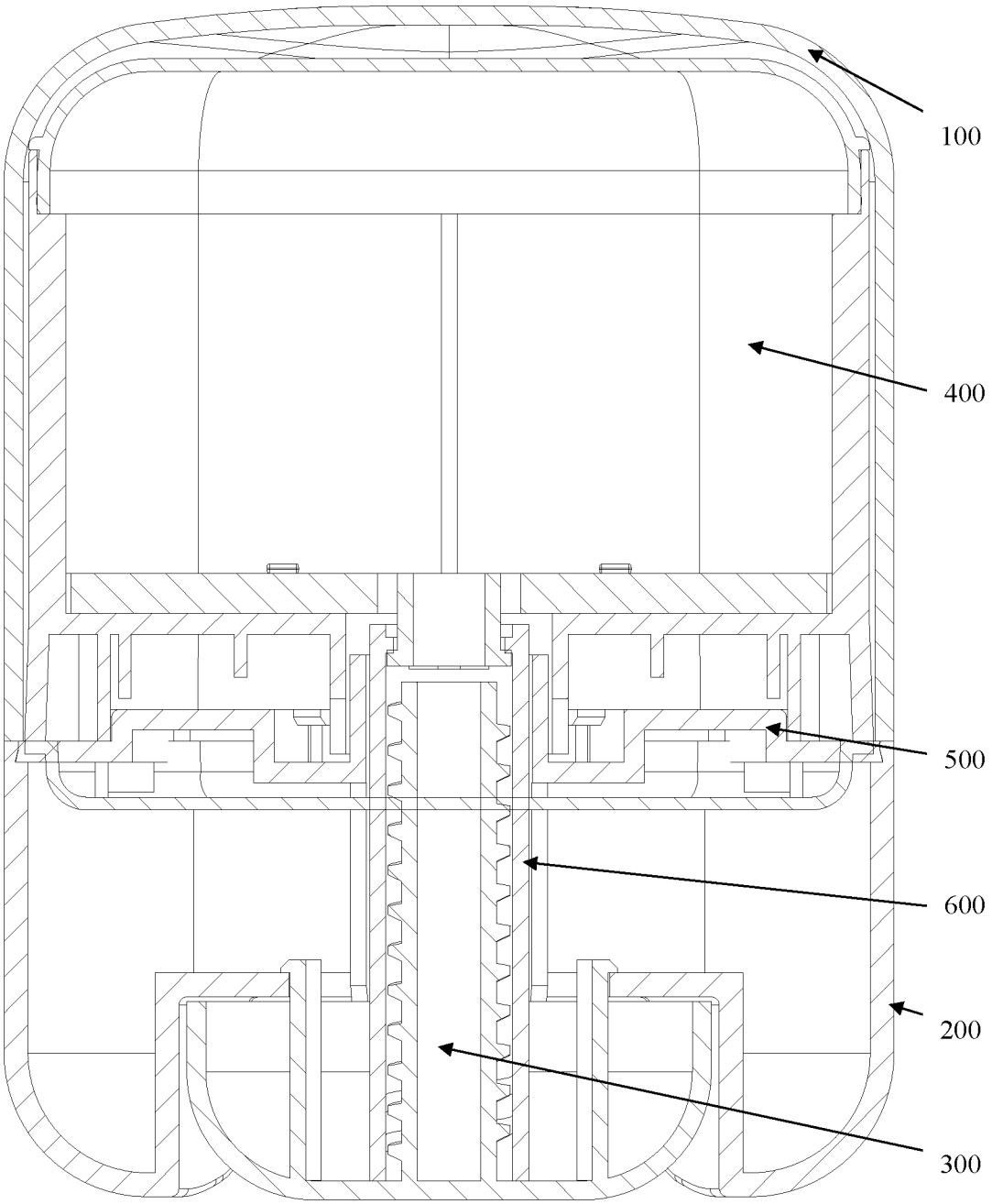
FIG. 5 is a sectional view taken along B-B in FIG. 3.
Figure 6:
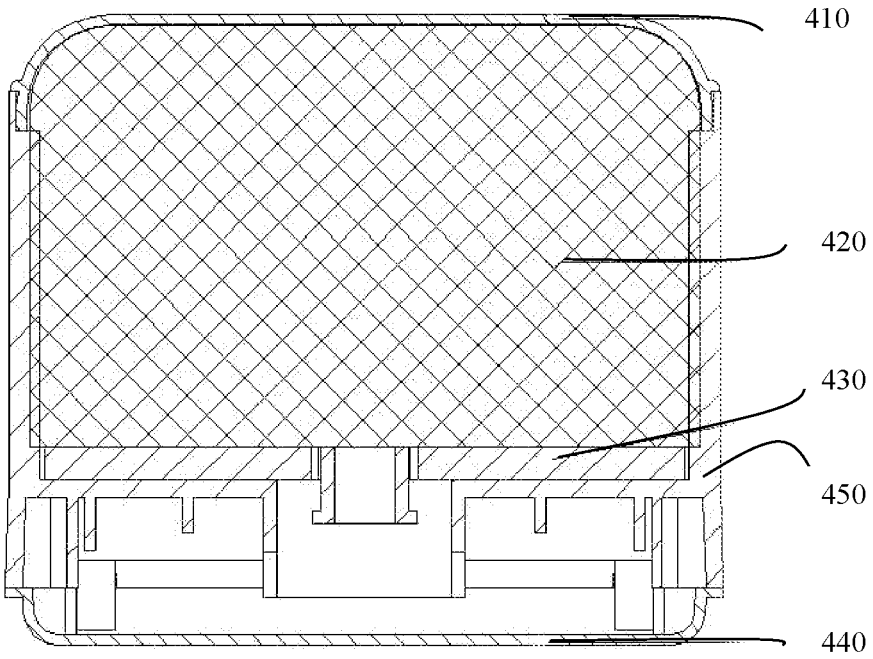
FIG. 6 is a cross-sectional view taken along a cross-sectional direction B-B in FIG. 5 of the replacement component filled with paste according to Embodiment 1 of the disclosure.
Figure 7:
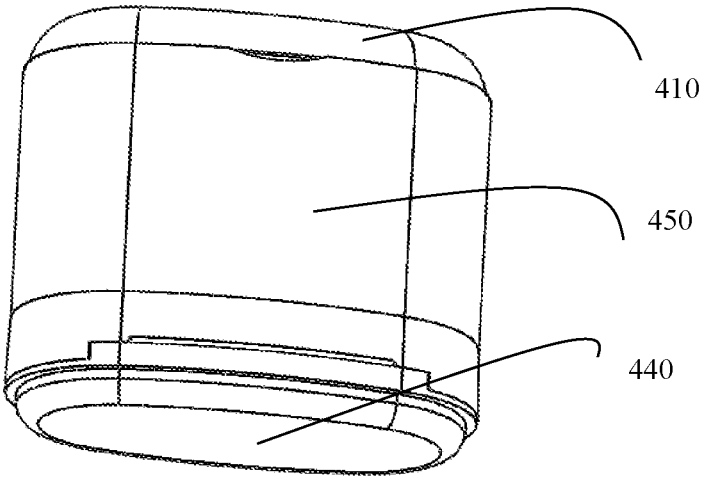
FIG. 7 is a schematic perspective view of a replacement component according to Embodiment 1 of the disclosure.
Figure 8:
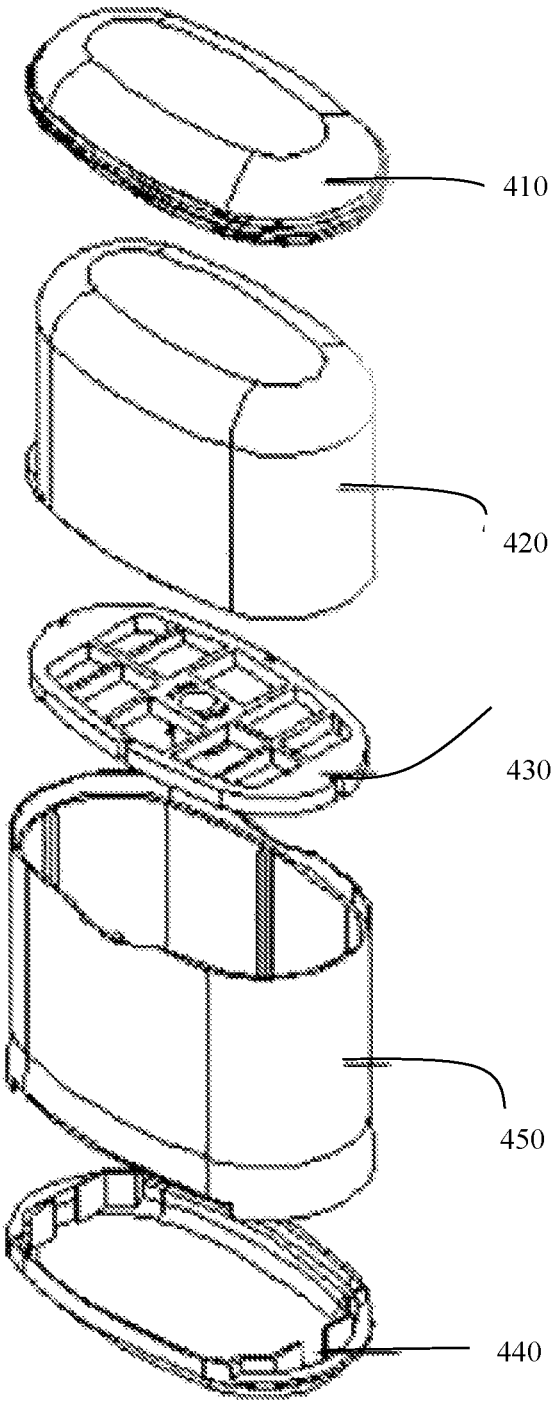
FIG. 8 is an exploded view of a replacement component according to Embodiment 1 of the disclosure.

In order to make the above and other objects, features and advantages of the utility model more obvious and understandable, a detailed description is made below for the preferred embodiments with reference to the accompanying drawings.

The bottom in this application refers to a part of the whole container proximate to the bottom cover, and the top is opposite to the bottom.

The lower end in this application refers to an end of the accommodating box proximate to the bottom cover, and the lower end is opposite to the upper end, "The plurality of" in this application means a valve of one, two and more than two.

Embodiment 1

Referring to FIGS. 1 to 26, this embodiment provides a replacement type container, which includes a replacement type component 400, a base 500, a bottom cover 200 and a rotating component 300. An accommodating cavity is provided in the replacement component 400, and a first clasp 451 is provided at a bottom of the replacement component 400. A second clasp 530 corresponding to the first clasp 451 is provided on the base 500, so that the first clasp 451 and the second clasp 530 can be snapped or separated by a relative rotation of the replacement component 400 and the base 500. The bottom cover 200 is provided with a first through hole 201 and is snapped with a lower end of the replacement component 400. The rotating component 300 includes a base 310 and a screw 330. The screw 330 is fixed on the base 310, and the base 310 is provided with a third clasp 311 for snapping with a hole edge of the first through hole 201; and the screw 330 passes through the first through hole 201 and is connected with the base 500 so that a rotation of the screw 330 causes the base 500 to move so as to lift the replacement component 400.

Figure 11:
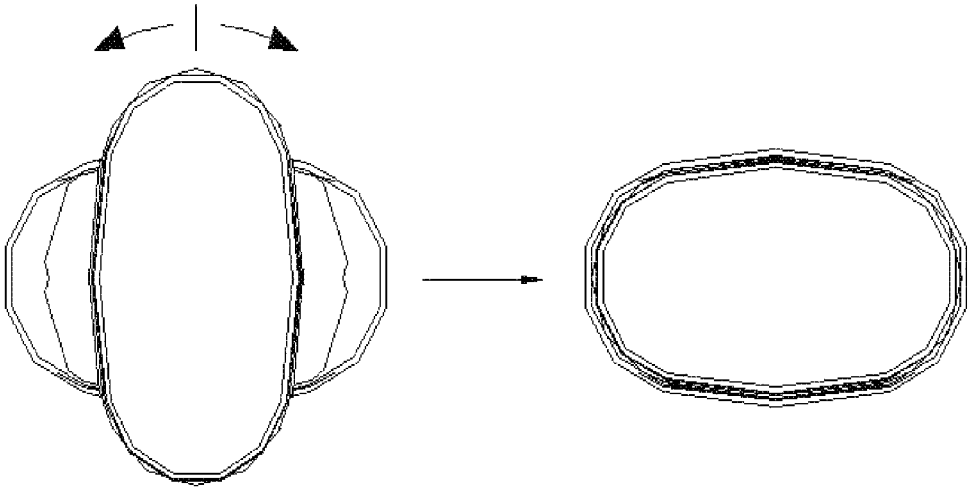
FIG. 11 it is a schematic diagram of rotary replacement of the replacement component according to Embodiment 1 of the disclosure.

As shown in FIGS. 2 to 5, in this embodiment, the replacement type container further includes a top cover 100, and the replacement component 400 is arranged in a cavity formed by snapping the top cover 100 and the bottom cover 200, and the base 310 is arranged in a cavity formed by snapping the base 500 and the bottom cover 200. An entire shape of the replacement type container of this embodiment is elliptic cylindrical, and a shape of the top cover 100 is an ellipsoid segment, that is, a shape of a part cut off from an ellipsoid like the "spherical segment shaped". A shape of the replacement component 400 is set according to the shape of the whole container, and is also an elliptic cylindrical. When the replacement component 400 is rotated, the replacement component 400 and the bottom cover 200 are misaligned, as shown in FIG. 11, which facilitate rotation. Moreover, the entire shape is jointly determined by shapes of the top cover 100 and the bottom cover 200. After the whole container is covered with the top cover 100, exposed parts are only the top cover 100, the bottom cover 200 and the rotating bottom cover 320, which is simple and elegant in appearance and convenient for storage.

Figure 14:
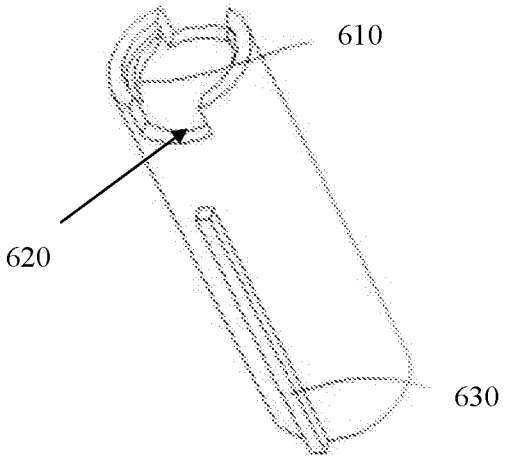
FIG. 14 is a schematic diagram of a threaded pushing tube according to Embodiment 1 of the disclosure.
Figure 15:
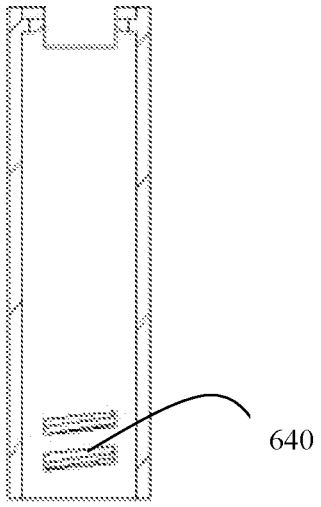
FIG. 15 is a sectional view of a threaded pushing tube according to Embodiment 1 of the disclosure.

Furthermore, as shown in FIG. 14 and FIG. 15, the replacement type container further includes a threaded pushing tube 600 which is threadedly matched with the screw 330, a top of the threaded pushing tube 600 is detachably connected with the bottom of the replacement component 400, and the threaded pushing tube 600 and the base 500 are respectively provided with a guide and a rail mutually matched with each other so that the screw 330 is connected with the base 500, and a rotation of the screw 330 causes the base 500 to move, and the rotation of the screw 330 drives the threaded pushing tube 600 which is threadedly matched with the screw 330 to move, while the threaded pushing tube can only move in a preset rail direction under an action of the guide and the rail; in this embodiment, the guide and the rail are both arranged along an axial direction of the screw 330, so that the threaded pushing tube 600 moves along the axial direction, thereby driving the base 500 to move along the axial direction, that is, to lift. The guide is a guide bar 630 attached to an outer wall of the cylindrical threaded pushing tube 600, the guide bar is arranged along an axial direction of the threaded pushing tube 600 and extends from a lower end of the threaded pushing tube 600.

In this embodiment, the bottom of the replacement component 400 is also provided with a fourth clasp 431 and the top of the threaded pushing tube 600 is provided with a fifth clasp 610 corresponding to the fourth clasp 431, so that the fourth clasp 431 and the fifth clasp 610 can be snapped or separated with each other by a relative rotation of the replacement component 400 and the threaded pushing tube 600, and a provision of the fourth clasp 431 and the fifth clasp further stabilizes the installation of the replacement component 400.

The top of the threaded pushing tube 600 is provided with axially symmetrically distributed second notches 620, and the second notches 620 are arranged between every adjacent fifth clasps, the second notch formed by recessing downward (towards the bottom cover 200) an upper end of the threaded pushing tube 600. In this embodiment, there are two second notches which are oppositely disposed and two fifth clasps which are also oppositely disposed. Rails distributed along the radial direction are also provided on an inner wall of the top of the threaded pushing tube 600. The rails are located below the fifth clasps; a bottom of the bottom plate 430 is provided with a bulge 432, and a lower end of the bulge 432 is provided with a fourth clasp 431. After an extension portion of the fourth clasp 431 extends into the second notch and then rotates along the rail, the fourth clasp 431 is snapped with the fifth clasp. The fifth clasp in this embodiment is formed by extending an edge of the upper end of the threaded pushing tube 600 inward (toward a central axis of the threaded pushing tube 600). An inner wall of the lower end of the threaded pushing tube 600 is also provided with threads 640 for threaded connection with the screw 330.

Figure 26:
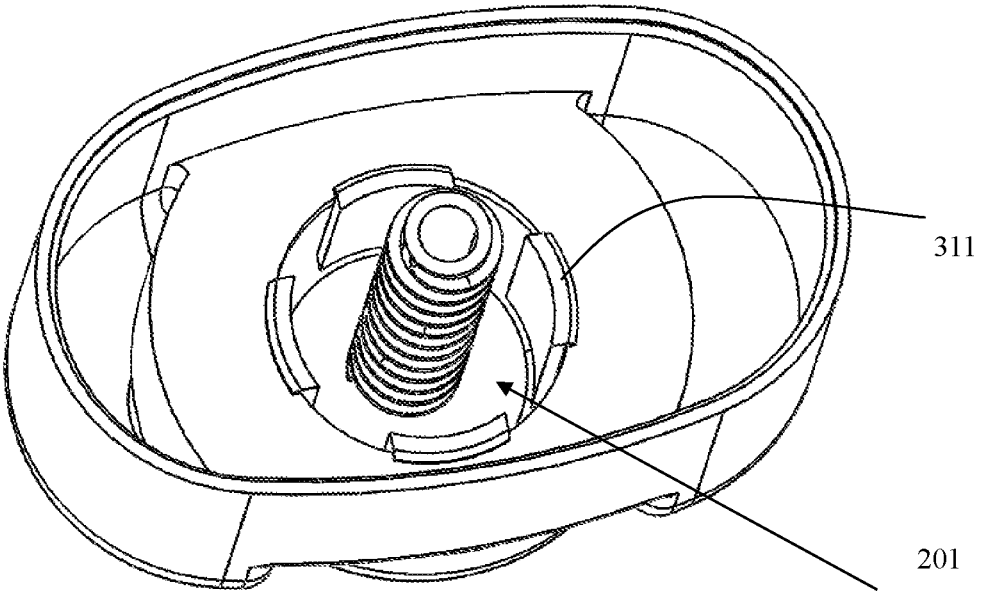
FIG. 26 is a schematic diagram of cooperation between the rotating component and the bottom cover according to Embodiment 1 of the disclosure.

As shown in FIG. 26, in this embodiment, there are four third clasps on the base 310 axially symmetrically distributed around the screw 330, and there is a gap between adjacent third clasps. The first through hole 201 is a circular through hole, and each of the third clasps includes an extension portion and a snapping portion, the extension portion extends from the base 310 and radially along the circular through hole, and the snapping portion is formed by bending a top end of the extension portion outward (away from a central axis of the screw 330). After the extension portion extends into the circular through hole, the snapping portion snaps a hole edge of the circular through hole.

Figure 16:
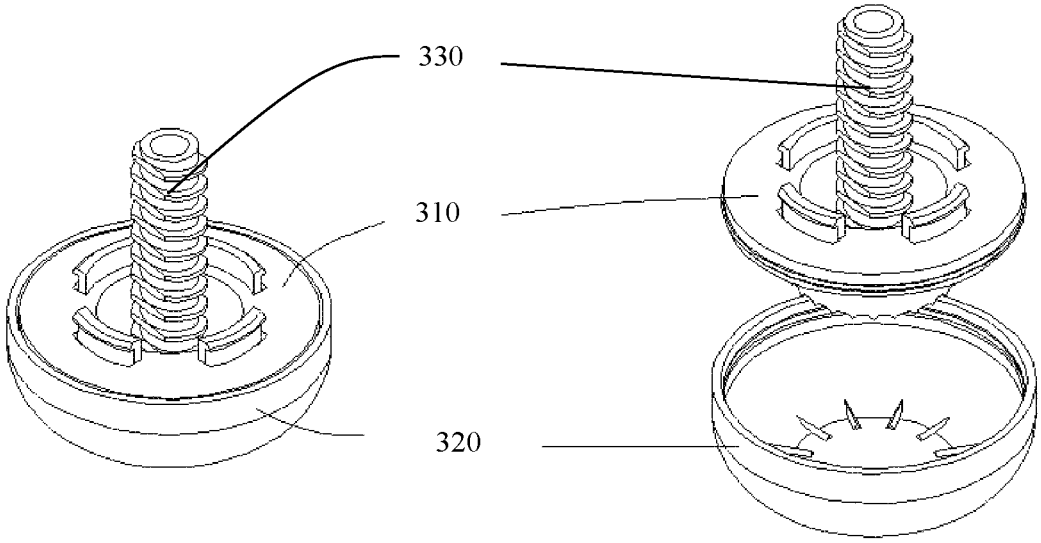
FIG. 16 shows a rotating component according to Embodiment 1 of the disclosure and its exploded view.
Figure 17:
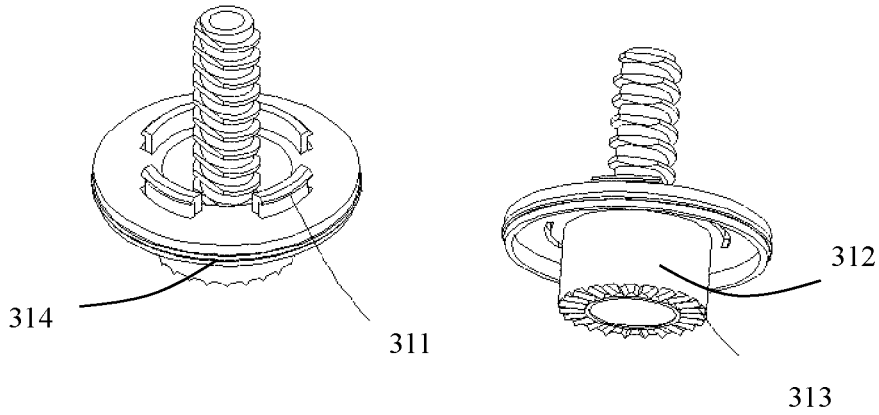
FIG. 17 shows schematic views at different views of the screw and the base according to Embodiment 1 of the disclosure.
Figure 18:
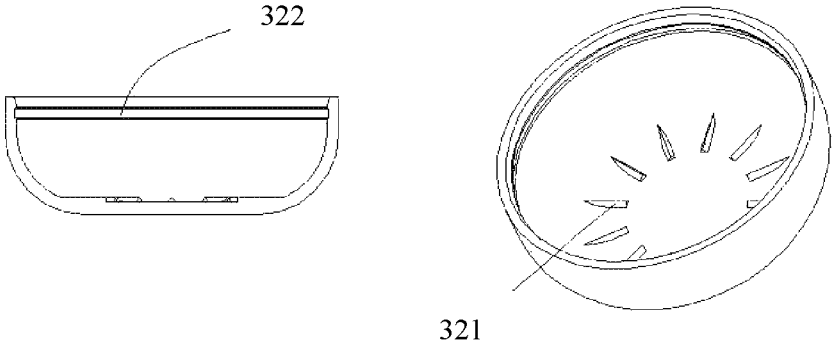
FIG. 18 shows schematic views at different views of the rotary bottom cover according to Embodiment 1 of the disclosure.
Figure 19:
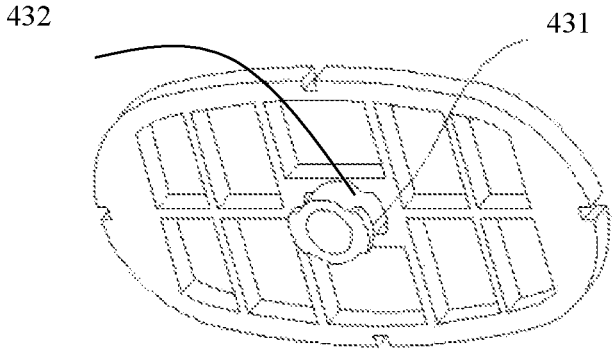
FIG. 19 is a schematic diagram of a bottom plate according to Embodiment 1 of the disclosure.

As shown m FIG. 16 to FIG. 18, the rotating component 300 further includes a rotating bottom cover 320. The rotating bottom cover 320 and the base 310 are respectively provided with a clasp 314 and a snapping groove 322 mutually matched with each other. The clasp and the snapping groove are respectively arranged at edges around the rotating bottom cover 320 and the base 310, and a lower side of the base 310 is provided with a cylindrical rotating block 312, and a bottom of the rotating block 312 is provided with a rotation preventing rib 313 matched with a rotation preventing rib 321 on an inner wall of the rotating bottom cover 320 so as to ensure that these two parts rotate synchronously.

Figure 20:
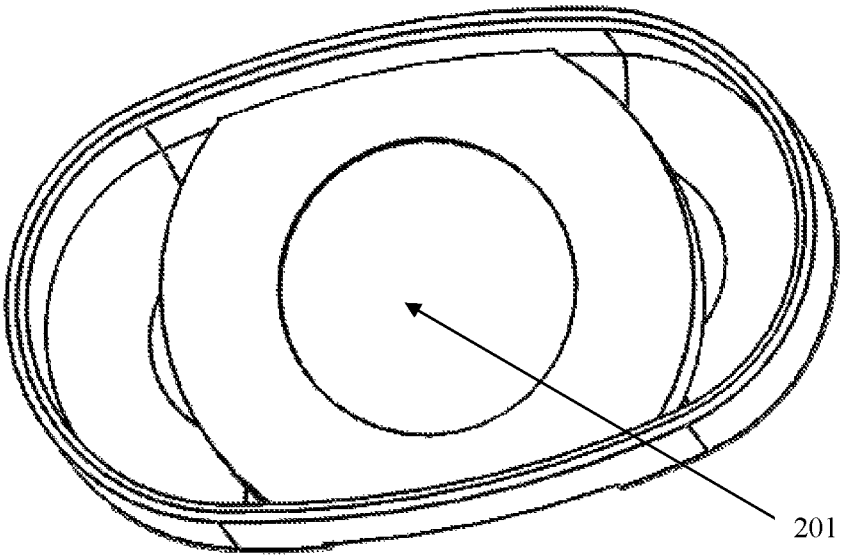
FIG. 20 is a first schematic diagram of a bottom cover according to Embodiment 1 of the disclosure.
Figure 21:
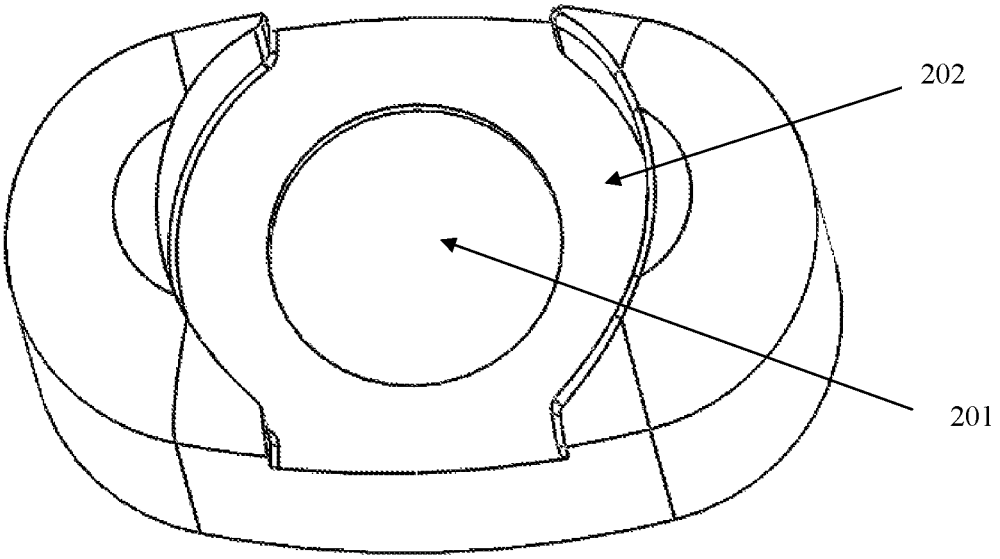
FIG. 21 is a second schematic diagram of a bottom cover according to Embodiment 1 of the disclosure.

As shown in FIG. 20 and FIG. 21, in this embodiment, a middle of the bottom cover 200 is recessed inwards (towards a direction to the top cover 100) and the first through hole 201 is arranged at this recess, the rotary bottom cover 320 is snapped with the base 310 passing through the first through hole 201, and the rotary bottom cover 320 is hidden in a recess 202 in the middle of the bottom cover 200. In this embodiment, A bottommost end of the rotary bottom cover 320 can be flush with a bottommost end of the bottom cover 200, which is convenient for the container to stand and place, and the recess can be a U-shaped recess, thus reserving a space for the rotary bottom cover 320 to rotate. A shape of the rotary bottom cover 320 is spherical segment shaped, and a diameter of the rotary bottom cover 320 is equal to a width of the bottom cover 200. When viewed from the top, the rotary bottom cover 320 is shielded by the top cover 100.

Figure 9:
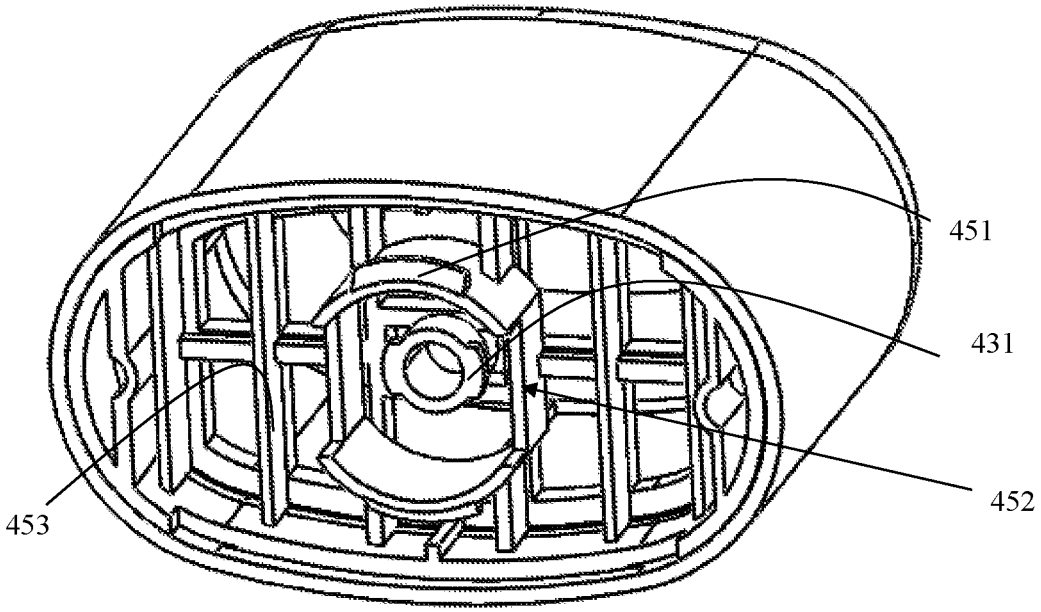
FIG. 9 is a bottom entity diagram of the replacement component with a lower cover removed according to Embodiment 1 of the disclosure.
Figure 22:
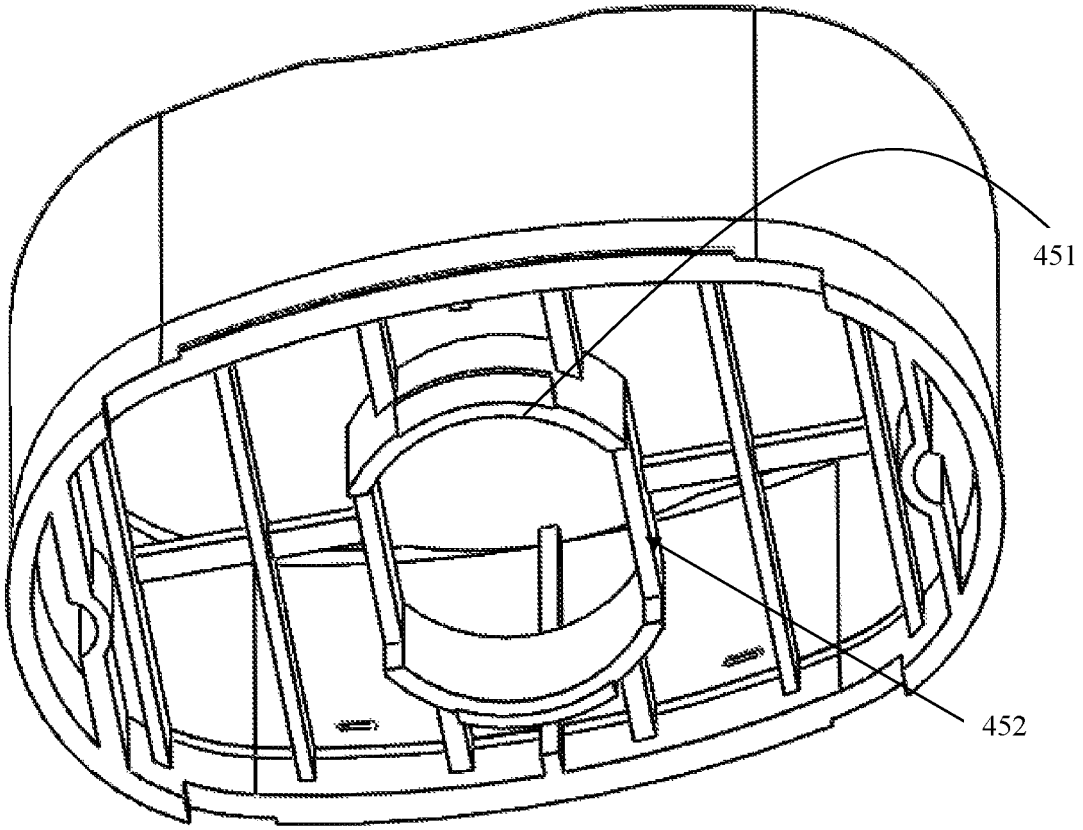
FIG. 22 is a schematic diagram of an accommodating box according to Embodiment 1 of the disclosure.
Figure 23:
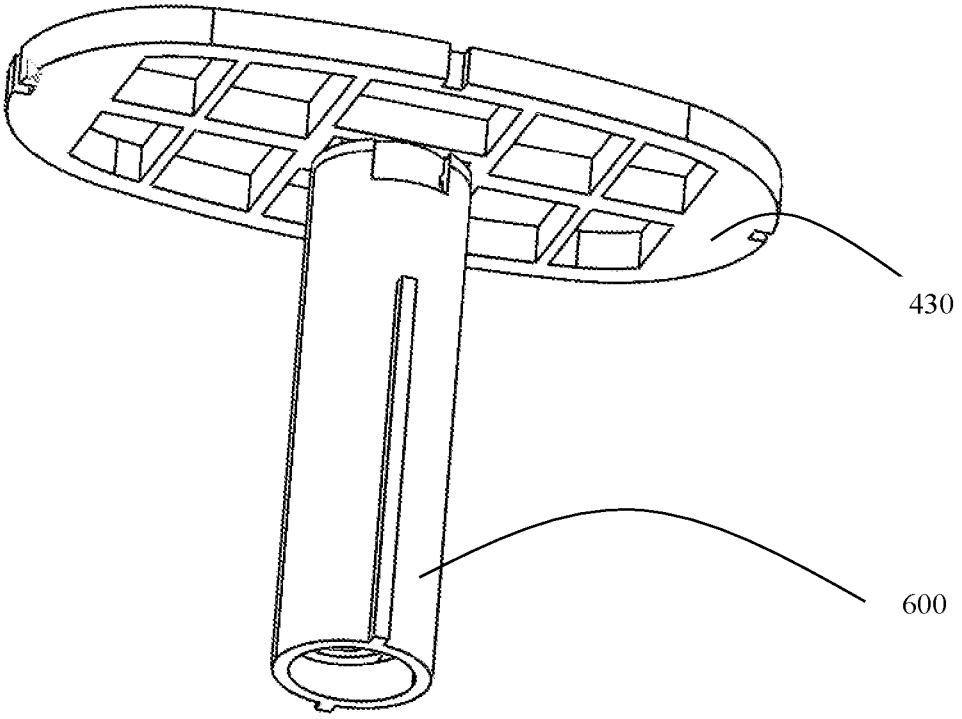
FIG. 23 is a schematic diagram of cooperation of the bottom plate and the threaded pushing tube according to Embodiment 1 of the disclosure.
Figure 24:
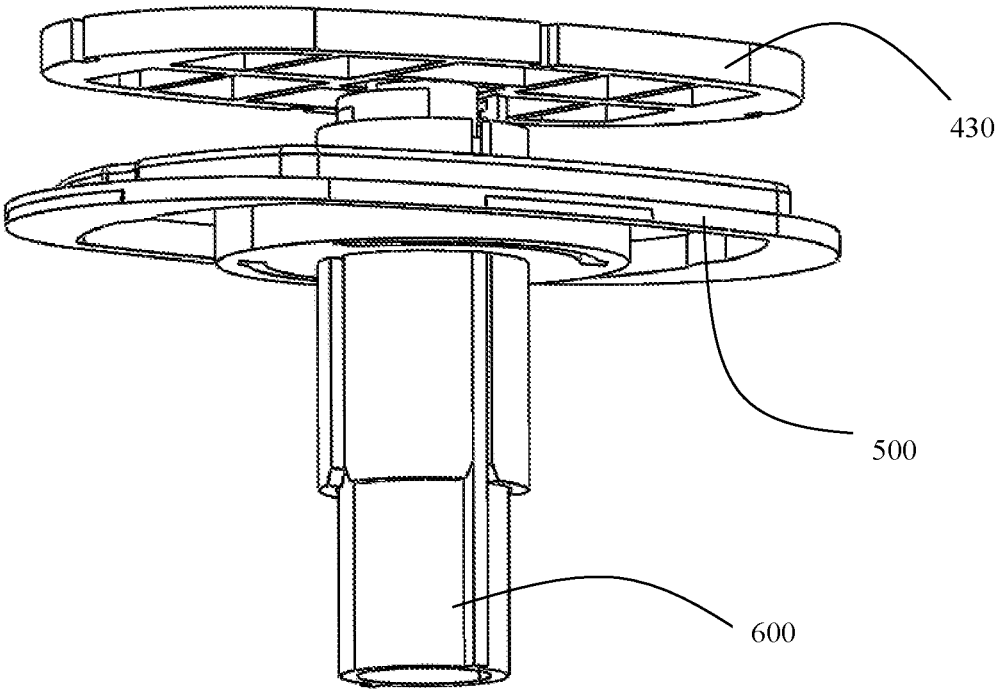
FIG. 24 is a schematic diagram of cooperation of the bottom plate, the threaded pushing tube and the base according to Embodiment 1 of the disclosure.
Figure 25:
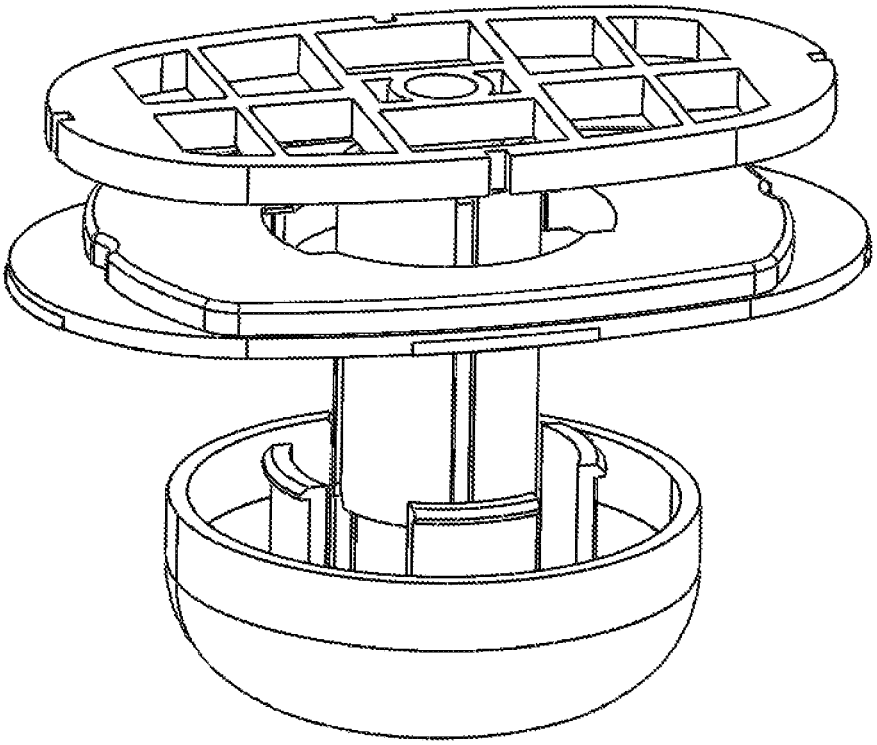
FIG. 25 is a schematic diagram of cooperation of the bottom plate, the threaded pushing tube, the rotating component and the base according to Embodiment 1 of the disclosure.

The bottom of the replacement component 400 in this embodiment is shown in FIG. 9, and the replacement component 400 includes an accommodating box 450 and a bottom plate 430. The bottom of the accommodating box 450 is shown in FIG. 22, which is provided with a first clasp 451, and the first clasp 451 is connected with the inner wall of the accommodating box 450 by a reinforcing rib 453. There are two first clasps 451, and grooves 452 are arranged between every two first clasps 451. The two first clasps 451 are oppositely disposed and the grooves are also oppositely disposed. The two first clasps 451 and the two grooves are respectively axially symmetrically distributed in a middle of the bottom of the accommodating box 450. A top of the accommodating box 450 is defined with an opening, the bottom plate 430 is arranged at a bottom of the accommodating box 450, the bottom of the accommodating box 450 is defined with a third through hole. The fourth clasp 431 of the bottom plate 430 passes through the third through hole and is snapped with the fifth clasp.

The replacement component 400 further includes a lower cover 440 and an upper cover 410. The lower cover 440 is snapped with a lower end of the accommodating box 450, and the upper cover 410 is in interference fit with an upper end of the accommodating box 450. When the replacement component 400 is installed, the lower cover 440 needs to be removed for installation, and the upper cover 410 can also be detachably connected with the upper end of the accommodating box 450.

Figure 12:
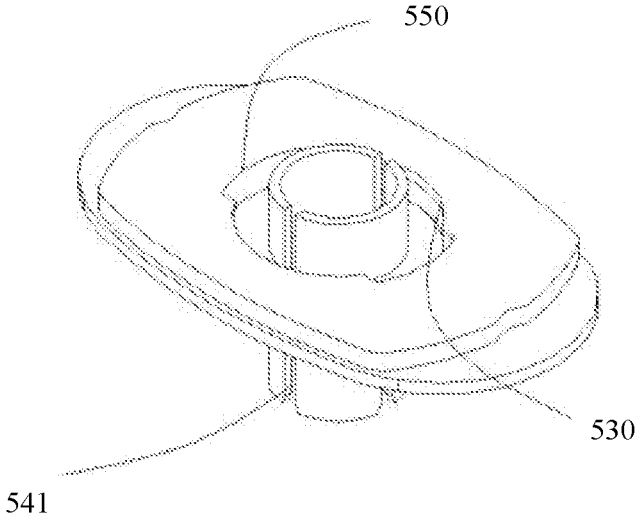
FIG. 12 is a first schematic diagram of a base according to Embodiment 1 of the disclosure.
Figure 13:
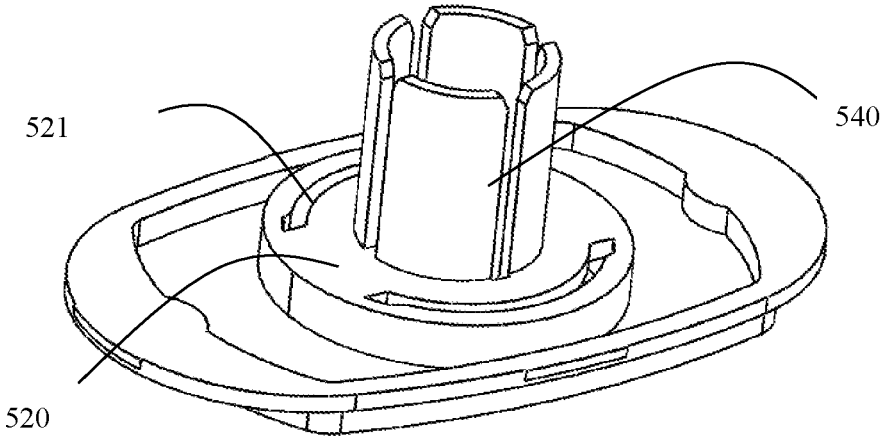
FIG. 13 is a second schematic diagram of a base according to Embodiment 1 of the disclosure.

As shown in FIG. 12 and FIG. 13, in this embodiment, there are two second clasps 530 in the base 500, and the base 500 is provided with axially symmetrically distributed first notches 550 and first notches 550 are arranged between every adjacent second clasps 530, and a number of the first notches 550 is also two. The two second clasps 530 and the two first notches 550 are symmetrically distributed in a middle of an upper end of the base 500. The base 500 is of an ellipse shape and plate-shaped, and its two ends in a direction of a major axis of the ellipse are recessed downward to snap with the bottom plate 430, and a middle part of the base forms a boss 510, and a middle of the boss is recessed downward to form a cylindrical groove 520 which protrudes from the other side of the base 500 (as shown in FIG. 13), Two first notches 550 are formed by further recessing the cylindrical groove, and the second clasps 530 are all arranged on inner wall of the cylindrical groove. A cylindrical limiting post 540 is formed by, extending from a groove bottom of the cylindrical groove to both sides respectively, and a rail 541 matched with the guide bar of the threaded pushing tube 600 are provided on the limiting post. The inner wall of the cylindrical groove is also provided with rails distributed along a radial direction of the cylindrical groove, which are located below the second clasp 530. The first clasps 451 are inserted from the first notches 550 and rotated along the rails below the second clasps 530 to be limited by the second clasps 530. The rails are closely matched with the first clasps 451, and the entire container is made of plastic material. In other embodiments, the entire container can also be made of other materials, which can be (or cannot be) pressed slightly when being snapped or disassembled, and with this slight deformation of the plastic, it is easy to screw in or out. The groove bottom of the cylindrical groove is also provided with an arc-shaped hole 521 to facilitate demoulding.

The base 500 is provided with a second through hole, the screw 330 passes through the first through hole 201 and is connected with a bottom of the threaded pushing tube 600, and the threaded pushing tube 600 passes through the second through hole and is connected with the bottom of the replacement component 400. A diameter of the second through hole is smaller than that of the first through hole 201.

Positions of the first notches 550 corresponds to positions of the second notches, and positions of the second clasps 530 are in one-to-one correspondence with positions of the fifth clasps, so as to ensure that the disassembly and installation of the threaded pushing tube 600 and the replacement component keeps synchronized with the disassembly and installation of the replacement component 400 and the base 500. Rotation angles for the replacement component 400 being snapped with the threaded pushing tube 600 and the base 500 respectively are the same, and rotation angles for the replacement component 400 being separated with the threaded pushing tube 600 and the base 500 respectively are the same. With this design, when rotated to a certain angle, the replacement component 400 is respectively snapped or separated with the threaded pushing tube 600 and the base 500, thus improving efficiency.

An assembly of the replacement type container in this embodiment can be made as follows: the rotary bottom cover 320 and the base 310 are snapped to form the rotating component 300, and the accommodating box 450, the bottom plate 430 and the upper cover 410 are combined to form the replacement type assembly 400. The screw 330 of the rotating component 300 passes through the bottom cover 200 and is threadedly connected with the lower end of the threaded pushing tube 600, and then the base 500 is snapped on the bottom cover 200; and the threaded top pipe 600 passes through the base 500 and is rotationally snapped with the replacement component 400, while the replacement component 400 and the support 500 are also rotationally snapped, and finally the top cover 100 is covered.

A method of using the replacement type container provided in the embodiment is as follows: when the screw 330 is rotated, the base 500 connected with the screw 330 is driven to move, so that the replacement type component 400 snapped with the base 500 is driven to lift, and thus the user can access contents 420 in the replacement type component 400. When the replacement component 400 is required to be replaced, it can be removed only by rotating the replacement component 400 so that the replacement component 400 and the base 500 rotate relatively to each other and the first clasp 451 and the second clasp 530 are separated with each other. When the replacement component 400 is installed, the first clasp 451 and the second clasp 530 can also be snapped with each other by rotating, thus finally realizing disassembly and installation of the base 500 and the replacement component 400.

Figure 10:
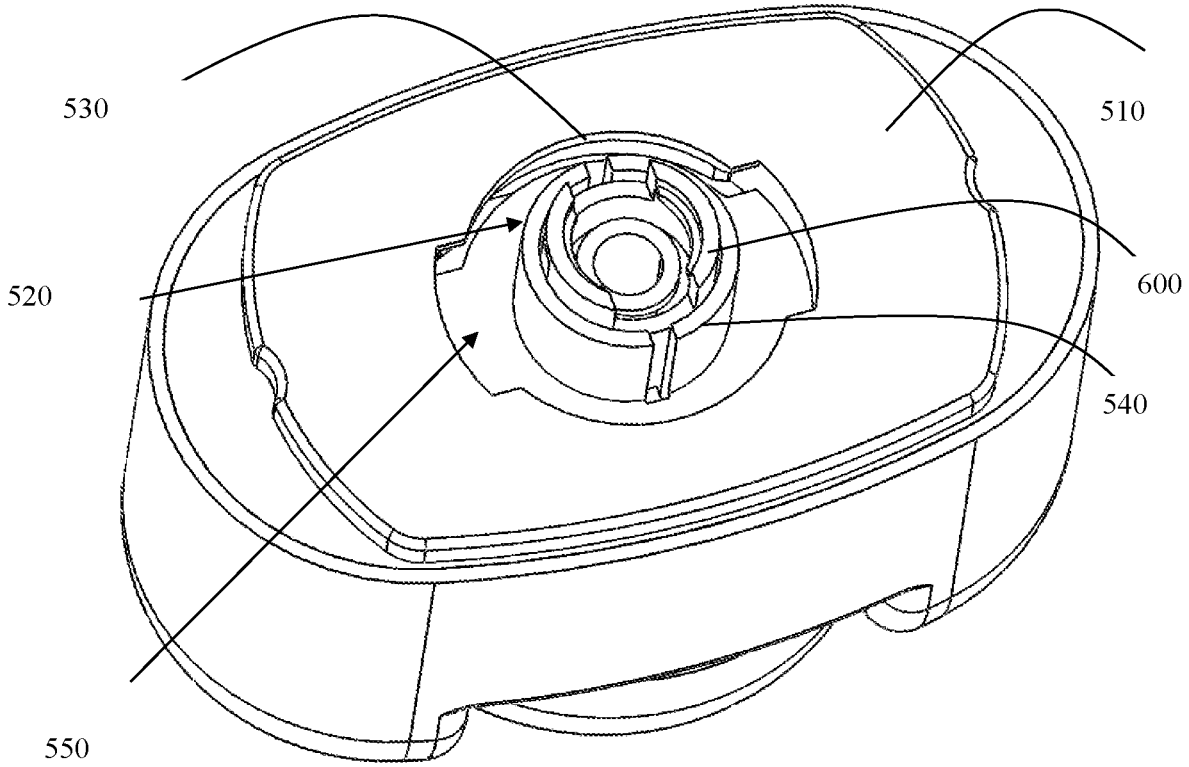
FIG. 10 is a schematic diagram of the replacement type container with the replacement component and a top cover removed according to Embodiment 1 of the disclosure.

When a rotating is made, the replacement type container is divided into two parts, one of which is the replacement component 400 (i.e., a part in FIG. 9), and the other of which is a remaining part except the top cover 100 and the replacement component 400 (i.e., a part in FIG. 10). When a rotating is made, these two parts rotate relatively to each other.

Embodiment 2

Please refer to FIG. 27 to FIG. 34, a top cover, a bottom cover and a rotating component in the second embodiment are the same as those in the first embodiment, and only differences are explained below.

Figure 27:
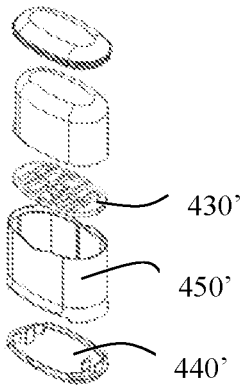
FIG. 27 is a schematic diagram of rotary replacement of the replacement component according to Embodiment 2 of the disclosure.
Figure 28:
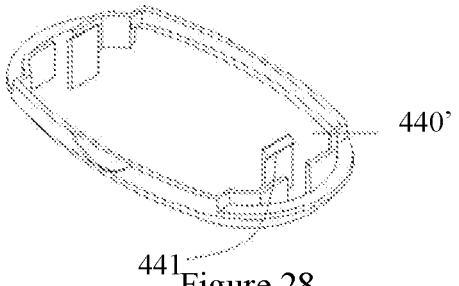
FIG. 28 is a schematic diagram of a lower cover according to Embodiment 2 of the disclosure.
Figure 29:
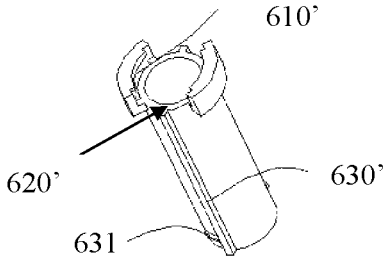
FIG. 29 is a schematic diagram of a threaded pushing tube according to Embodiment 2 of the disclosure.
Figure 33:
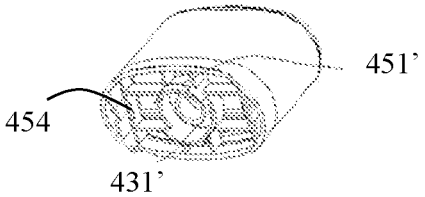
FIG. 33 is a bottom entity diagram of the replacement component with a lower cover removed according to Embodiment 2 of the disclosure.
Figure 34:
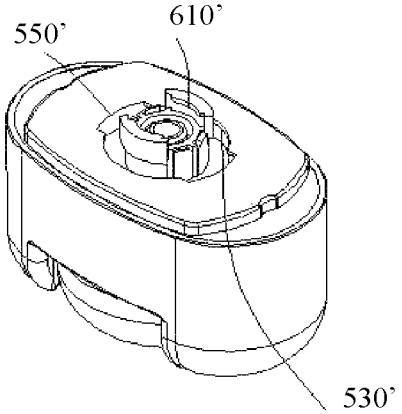
FIG. 34 is a schematic diagram of the replacement type container with the replacement component and a top cover removed according to Embodiment 2 of the disclosure.

As shown in FIG. 27, FIG. 28 and FIG. 33, in order to facilitate a detachable connection between an accommodating box 450' and a lower cover 440' in the replacement component, the lower cover 440' and a 'bottom of the accommodating box 450' are respectively provided with a claw 441 and a corresponding snapping rib 454 in this embodiment, there are two claws and two snapping ribs respectively, and the claws can be snapped and fixed with the snapping ribs.

Figure 30:
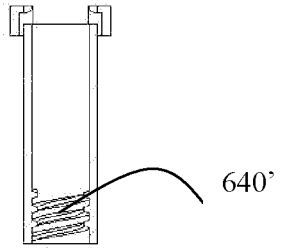
FIG. 30 is a sectional view of a threaded pushing tube according to Embodiment 2 of the disclosure.
Figure 31:
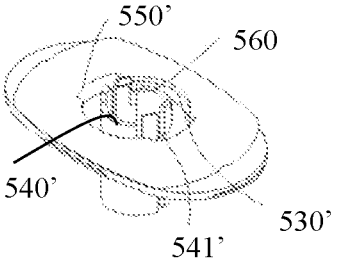
FIG. 31 is a schematic diagram of a base according to Embodiment 2 of the disclosure.
Figure 32:
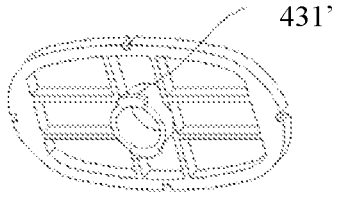
FIG. 32 is a schematic diagram of a bottom plate according to Embodiment 2 of the disclosure.

As shown in FIG. 29 to FIG. 31 and FIG. 33, a bottom of the bottom plate 430' is provided with a fourth clasp 431', and a top of the threaded pushing tube is provided with a fifth clasp 610' corresponding to the fourth clasp 431'. The fifth clasp extends upward (along an axial direction of the threaded pushing tube and toward a direction away from the threaded pushing tube) and outward (along a radial direction and toward a direction away from a central axis of the threaded pushing tube) from the top of the threaded pushing tube. That is, the fifth clasp is higher than the threaded pushing tube in the axial direction of the threaded pushing tube and thus a second notch 620' is firmed between adjacent fifth clasps, and the fifth clasp is wider than the threaded pushing tube in the radial direction of the threaded pushing tube. In FIG. 30, a diameter of an inner wall of the fifth clasp is slightly smaller than that of an inner wall of the threaded pushing tube, and in other embodiments, the diameter of the inner wall of the fifth clasp can be equal to or larger than the diameter of the inner wall of the threaded pushing tube. The fourth clasp and the fifth clasp can be snapped or separated by a relative rotation of the replacement component and the threaded pushing tube.

There are two second notches which are oppositely disposed and two fifth clasps which are also oppositely disposed. After an extension portion of the fourth clasp 431' extends into the second notch and then rotates along the rail, the fourth clasp 431' is snapped with the fifth clasp. An inner wall of a lower end of the threaded pushing tube is also provided with threads 640' for threaded connection with the screw.

A guide in this embodiment is a guide bar 630' attached to an outer wall of the cylindrical threaded pushing tube, the guide bar is arranged along the axial direction of the threaded pushing tube and extends from the lower end of the threaded pushing tube to an upper end of the threaded pushing tube. In addition, a cylindrical limiting post 540' is formed by extending from a groove bottom of the cylindrical groove of the base to both sides respectively and a rail 541' matched with the guide bar of the threaded pushing tube are provided on the limiting post. The guide bar 630' moves along the rail 541'.

As shown in FIG. 31 to FIG. 34, an end of the rail (proximate to the lower end of the threaded pushing tube) is provided with steps 631, while a top end of a part of the limiting post 540' extends upward and is provided with two claws 560, and the claws 560 and the steps 631 cooperate with each other for limiting. In a later period of use, when the top and bottom plates on the threaded pushing tube drives the replacement component to move upward and the threaded pushing tube has moved up to an end of a stroke, at this time, the two claws on the base will contact with the two steps on the threaded pushing tube, thus preventing the threaded pushing tube from continuing to moving upward and falling off the base.

Unlike the embodiment in which the rail is arranged in a minor axis direction of the elliptical bottom plate, the rail is arranged in a major axis direction of the elliptical bottom plate in this embodiment. In this embodiment, the first clasps 451' and the fourth clasps 431' are all on a same line, and similarly, the first notches 550', the second notches 620 and the rails 541' are also on a same line, and an arrangement direction of the two first clasps is perpendicular to an arrangement direction of the two first notches 550', that is to say, when the replacement component is rotated by 90 degrees, the replacement component can be snapped or separated from the base while the replacement component can be snapped or separated from the threaded pushing tube.

It should be understood by those skilled in the art that in the disclosure of the utility model, the orientation or positional relationship indicated by the terms upper“,” lower", “front”, “rear”, “left”, “right”, “vertical”, “horizontal”, “top”, “bottom”, “inner” and “outer” or the like are based on the orientation or positional relationship shown in the drawings, which are only for convenience of describing the utility model and for simplifying the description, but do not indicate or imply that the indicated device or element must have a specific orientation, be constructed and operate in a specific orientation; therefore the above-mentioned terms cannot be understood as limitations to the utility model.

Although the utility model has been disclosed by the preferred embodiment in the above, it is not intended to limit the utility model and any person familiar with the art can make some changes and embellishments without departing from the spirit and scope of the utility model; therefore, the scope of protection of the utility model should be subject to the scope of protection as claimed in the claims.

What is claimed is:

1. A replacement type container, comprising:

a replacement component, an accommodating cavity being provided in the replacement component, a first clasp being provided at a bottom of the replacement component;

a base, being provided with a second clasp corresponding to the first clasp, so that the first clasp and the second clasp are snapped or separated by a relative rotation of the replacement component and the base;

a bottom cover, being provided with a first through hole and the bottom cover being snapped with a lower end of the replacement component; and a rotating component, comprising a base and a screw, the screw being fixed at the base and the base being provided with a third clasp for snapping with a hole edge of the first through hole; and the screw passing through the first through hole and being connected with the base, wherein the replacement type container further comprises a threaded pushing tube, the threaded pushing tube is threadedly matched with the screw, a top of the threaded pushing tube being detachably connected with the bottom of the replacement component, and the threaded pushing tube and the base being respectively provided with a guide and a rail mutually matched with each other so that the screw is connected with the base, and a rotation of the screw causes the base to move, so that a rotation of the screw causes the threaded pushing tube to move so as to lift the replacement component.

2. The replacement type container according to claim 1, wherein the bottom of the replacement component is also provided with a fourth clasp and the top of the threaded pushing tube is provided with a fifth clasp corresponding to the fourth clasp, so that the fourth clasp and the fifth clasp are snapped or separated with each other by a relative rotation of the replacement component and the threaded pushing tube.

3. The replacement type container according to claim 2, wherein the base is provided with a second through hole, the screw passes through the first through hole and is connected with a bottom of the threaded pushing tube, and the threaded pushing tube passes through the second through hole and is connected with the bottom of the replacement component.

4. The replacement type container according to claim 3, wherein rotation angles for the replacement component being snapped with the threaded pushing tube and the base respectively are the same, and rotation angles for the replacement component being separated with the threaded pushing tube and the base respectively are the same.

5. The replacement type container according to claim 4, wherein the replacement component comprises an accommodating box and a bottom plate, a top of the accommodating box being defined with an opening, the bottom plate being arranged at a bottom of the accommodating box, the first clasp being arranged at the bottom of the accommodating box, the fourth clasp being arranged on the bottom plate, the bottom of the accommodating box is defined with a third through hole, and the fourth clasp passing through the third through hole and being snapped with the fifth clasp.

6. The replacement type container according to claim 5, wherein the replacement component further comprises a lower cover and an upper cover, the lower cover being snapped with a lower end of the accommodating box and the upper cover being in interference fit with an upper end of the accommodating box.

7. The replacement type container according to claim 2, wherein there are a plurality of first clasps, a plurality of second clasps and a plurality of fifth clasps, and the plurality of first clasps, the plurality of second clasps and the plurality of fifth clasps are respectively axially symmetrically distributed.

8. The replacement type container according to claim 7, wherein the base is provided with axially symmetrically distributed first notches, the first notches being arranged between every adjacent second clasps; and the top of the threaded pushing tube is provided with axially symmetrically distributed second notches, the second notch being arranged between every adjacent fifth clasps, positions of the first notches corresponding to positions of the second notches and positions of the plurality of second clasps being in one-to-one correspondence with positions of the plurality of fifth clasps.

9. The replacement type container according to claim 1, wherein the guide and the rail are both arranged along an axial direction of the screw.

10. The replacement type container according to claim 9, wherein there are a plurality of third clasps, the plurality of third clasps are symmetrically distributed, the first through hole is a circular through hole, one or more of the plurality of third clasps comprises extension portions extending radially along the circular through hole and snapping portions, after the extension portions extend into the circular through hole, the snapping portions snap a hole edge of the circular through hole.

11. The replacement type container according to claim 9, wherein the rotating component further comprises a rotating bottom cover, the rotating bottom cover and the base being respectively provided with a clasp and a snapping groove mutually matched with each other, and rotation preventing ribs mutually matched with each other being respectively provided on the rotating bottom cover and the base.

12. The replacement type container according to claim 11, wherein a middle of the bottom cover is recessed inwards, and the first through hole is arranged at this recess, and the rotary bottom cover is snapped with the base passing through the first through hole.

13. The replacement type container according to claim 9, wherein the replacement type container further comprises a top cover, and the replacement component is arranged in a cavity formed by snapping the top cover and the bottom cover, and the base is arranged in a cavity formed by snapping the base and the bottom cover.

14. The replacement type container according to claim 6, wherein there are a plurality of first clasps, a plurality of second clasps and a plurality of fifth clasps, and the plurality of first clasps, the plurality of second clasps and the plurality of fifth clasps are respectively axially symmetrically distributed.

15. The replacement type container according to claim 6, wherein the guide and the rail are both arranged along an axial direction of the screw.

16. The replacement type container according to claim 15, wherein there are a plurality of third clasps, the plurality of third clasps are symmetrically distributed, the first through hole is a circular through hole, one or more of the plurality of third clasps comprises extension portions extending radially along the circular through hole and snapping portions, after the extension portions extend into the circular through hole, the snapping portions snap a hole edge of the circular through hole.

17. The replacement type container according to claim 15, wherein the rotating component further comprises a rotating bottom cover, the rotating bottom cover and the base being respectively provided with a clasp and a snapping groove mutually matched with each other, and rotation preventing ribs mutually matched with each other being respectively provided on the rotating bottom cover and the base.

18. The replacement type container according to claim 17, wherein a middle of the bottom cover is recessed inwards, and the first through hole is arranged at this recess, and the rotary bottom cover is snapped with the base passing through the first through hole.

19. The replacement type container according to claim 15, wherein the replacement type container further comprises a top cover, and the replacement component is arranged in a cavity formed by snapping the top cover and the bottom cover, and the base is arranged in a cavity formed by snapping the base and the bottom cover.

* * * * *